US009429123B2

(12) United States Patent
Inose et al.

(10) Patent No.: US 9,429,123 B2
(45) Date of Patent: Aug. 30, 2016

(54) VANE PUMP

(71) Applicant: Showa Corporation, Gyoda-shi (JP)

(72) Inventors: Yoshiyuki Inose, Haga-gun (JP); Hiroyuki Ishihama, Haga-gun (JP)

(73) Assignee: SHOWA CORPORATION, Gyoda-Shi (JP)

( * ) Notice: Subject to any disclaimer, the term of this patent is extended or adjusted under 35 U.S.C. 154(b) by 135 days.

(21) Appl. No.: 14/316,165

(22) Filed: Jun. 26, 2014

(65) Prior Publication Data

US 2015/0167608 A1 Jun. 18, 2015

(30) Foreign Application Priority Data

Dec. 18, 2013 (JP) ..... 2013-260876

(51) Int. Cl.

| | |
|---|---|
| ***F04C 2/02*** | (2006.01) |
| ***F04C 15/06*** | (2006.01) |
| ***F01C 1/067*** | (2006.01) |
| ***F01C 21/18*** | (2006.01) |
| ***F02M 59/12*** | (2006.01) |
| ***F01C 21/10*** | (2006.01) |
| ***F04C 2/344*** | (2006.01) |

(52) U.S. Cl.

CPC ..... *F02M 59/12* (2013.01); *F01C 21/108* (2013.01); *F04C 2/3446* (2013.01); *F04C 15/06* (2013.01)

(58) Field of Classification Search

CPC ..... F04C 15/06; F04C 2/12
USPC ..... 418/133, 268, 82
See application file for complete search history.

(56) References Cited

U.S. PATENT DOCUMENTS

2003/0091452 A1* 5/2003 Szeszulski ..... F01C 21/0863 418/82
2007/0134120 A1 6/2007 Fujita et al.

FOREIGN PATENT DOCUMENTS

JP 2007-162554 A 6/2007

* cited by examiner

*Primary Examiner* — Jesse Bogue
*Assistant Examiner* — Deming Wan
(74) *Attorney, Agent, or Firm* — Leason Ellis LLP

(57) ABSTRACT

A vane pump includes: a rotor that is coupled with a rotation shaft to rotate; a plurality of vanes that are slidably held by a plurality of vane grooves which are disposed in a radiation direction in an outer circumferential portion of the rotor; a cam ring that is arranged to surround the rotor and the plurality of vanes; and a side plate that covers the cam ring and includes a supply unit which supplies a working fluid into the cam ring between the cam ring, an outer circumference of the side plate being recessed to a radially inner side of the rotation shaft to form the supply unit, in which an outer circumference of the supply unit and an inner circumference of the cam ring are shaped along each other.

9 Claims, 11 Drawing Sheets

VANE PUMP

CROSS-REFERENCE TO RELATED APPLICATIONS

This application is based on and claims priority under 35 USC 119 from Japanese Patent Application No. 2013-260876 filed on Dec. 18, 2013, the entire content of which is incorporated herein by reference.

BACKGROUND OF THE INVENTION

1. Technical Field

The present invention relates to a vane pump.

2. Related Art

A vane pump includes a rotating rotor, a cam ring that is arranged to surround the rotor, a plurality of vanes (wings) that are slidably held by a plurality of vane grooves which are disposed in a radiation direction of the rotor, and a plurality of pump chambers that are partitioned by the two vanes which are adjacent in the vicinity of the rotor. The volume of the pump chamber is repeatedly increased and decreased by the rotation of the rotor. A plurality of suction ports are disposed in a side plate or the like at a position that corresponds to the expansion process of the pump chamber and a plurality of discharge ports are disposed in the side plate or the like at a position that corresponds to the contraction process. The vane pump supplies, for example, a working oil to a target device that is a supply target (refer to, for example, JP-A-2007-162554).

SUMMARY OF THE INVENTION

The suction area where the working oil is suctioned increases when a position of an end portion of the rotor on the rotation shaft side becomes closer to the rotation shaft and an opening of a supply unit of the side plate is widened. In this manner, the amount of suction of the working oil is increased and the suction efficiency is improved. However, the area where the vanes are supported by the side plate or the like is decreased as the supply unit becomes closer to the rotation shaft. As a result, the vanes become unstable in posture and, for example, the vanes are inclined such that corners of the vanes come into contact with the side plate or the like. This may result in burning of the vanes and the side plate or an abnormal noise.

An illustrative aspect of the invention is to suppress instability of a posture of a vane and improve suction efficiency of a supply unit of a side plate.

According to an aspect of the invention, there is provided a vane pump including a rotor that is coupled with a rotation shaft to rotate, a plurality of vanes that are slidably held by a plurality of vane grooves which are disposed in a radiation direction in an outer circumferential portion of the rotor, a cam ring that is arranged to surround the rotor and the plurality of vanes, and a side plate that covers the cam ring and has a supply unit which supplies a working fluid into the cam ring between the cam ring, an outer circumference of the side plate being recessed to a radially inner side of the rotation shaft to form the supply unit, in which an outer circumference of the supply unit and an inner circumference of the cam ring are shaped along each other.

In the aspect, the vane pump may further include another side plate that is arranged on a side opposite to the side plate across the cam ring to cover the cam ring and has another supply unit which supplies the working fluid into the cam ring between the cam ring, an outer circumference of said another side plate being recessed to the radially inner side of the rotation shaft to form said another supply unit, in which an outer circumference of said another supply unit and the inner circumference of the cam ring are shaped along each other.

In the aspect, the side plate may have a through-hole, on the radially inner side of the rotation shaft compared to the supply unit, which supplies the working fluid pressing the plurality of vanes to allow the plurality of vanes to protrude from the rotor into the cam ring, and a radially outer side of the rotation shaft in the through-hole may be shaped along the inner circumference of the cam ring.

According to any aspect of the invention, instability of the posture of the vanes can be suppressed, and the suction efficiency of the supply unit of the side plate can be improved.

DETAILED DESCRIPTION OF THE INVENTION

Hereinafter, configuration examples of the invention will be described in detail with reference to the accompanying drawings.

Figure 1:
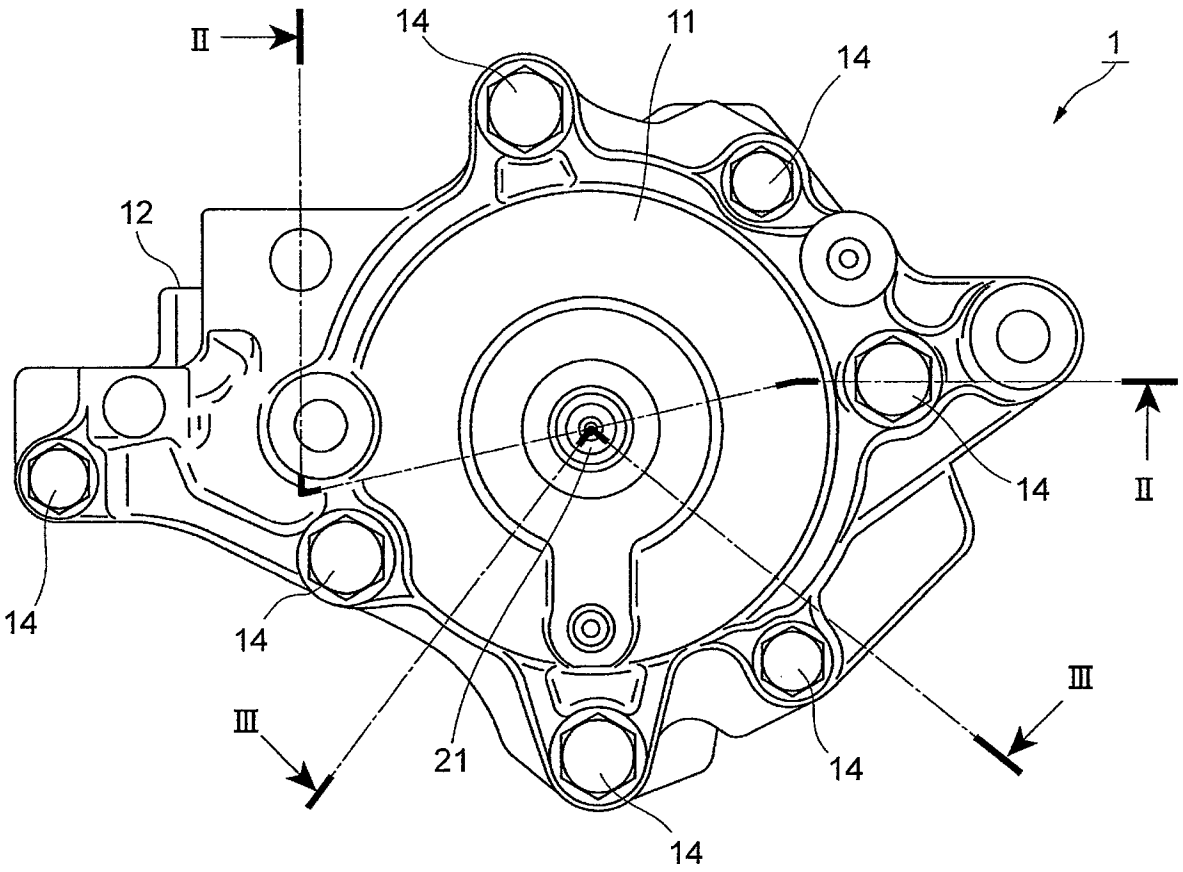
FIG. 1 is an overall view of a vane pump to which this configuration example is applied.
Figure 2:
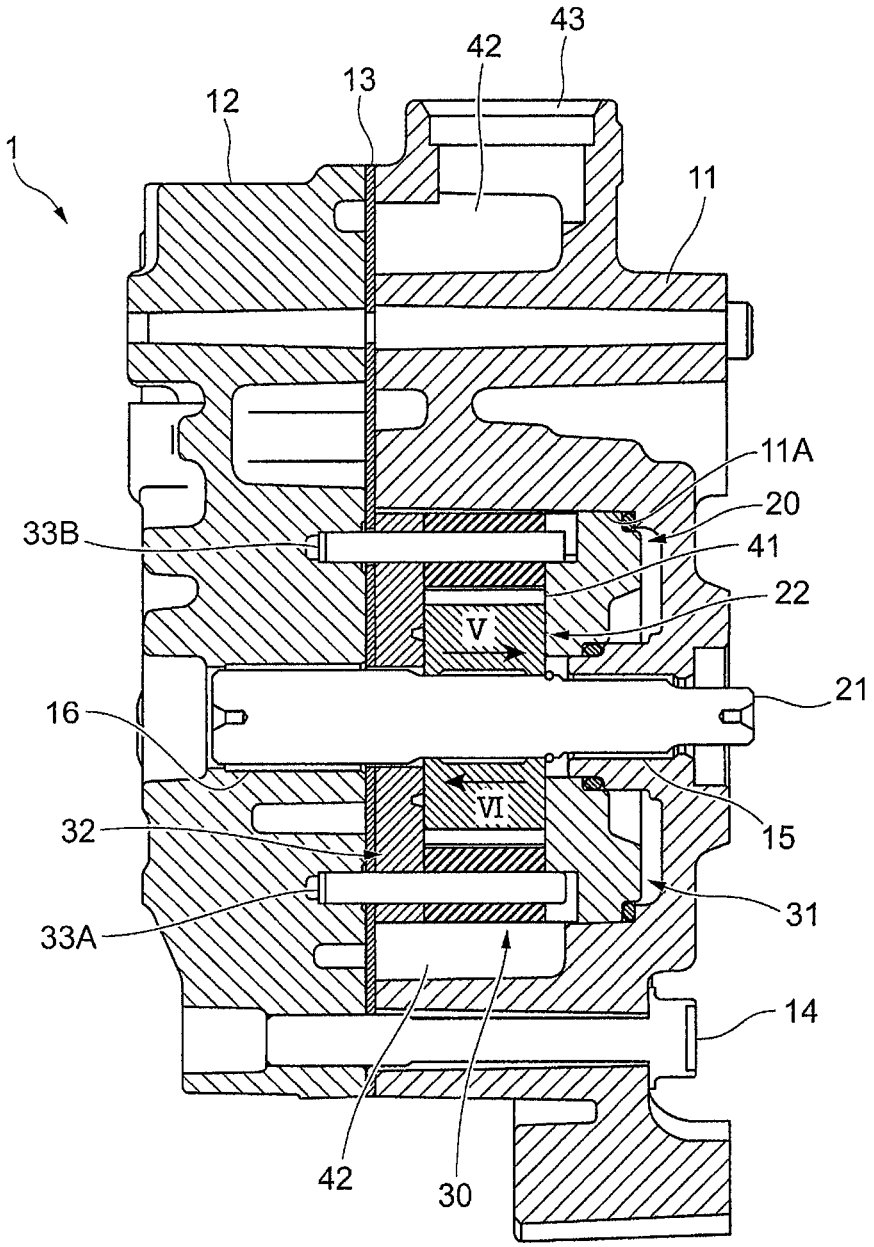
FIG. 2 is a cross-sectional view taken along line II-II of FIG. 1.
Figure 3:
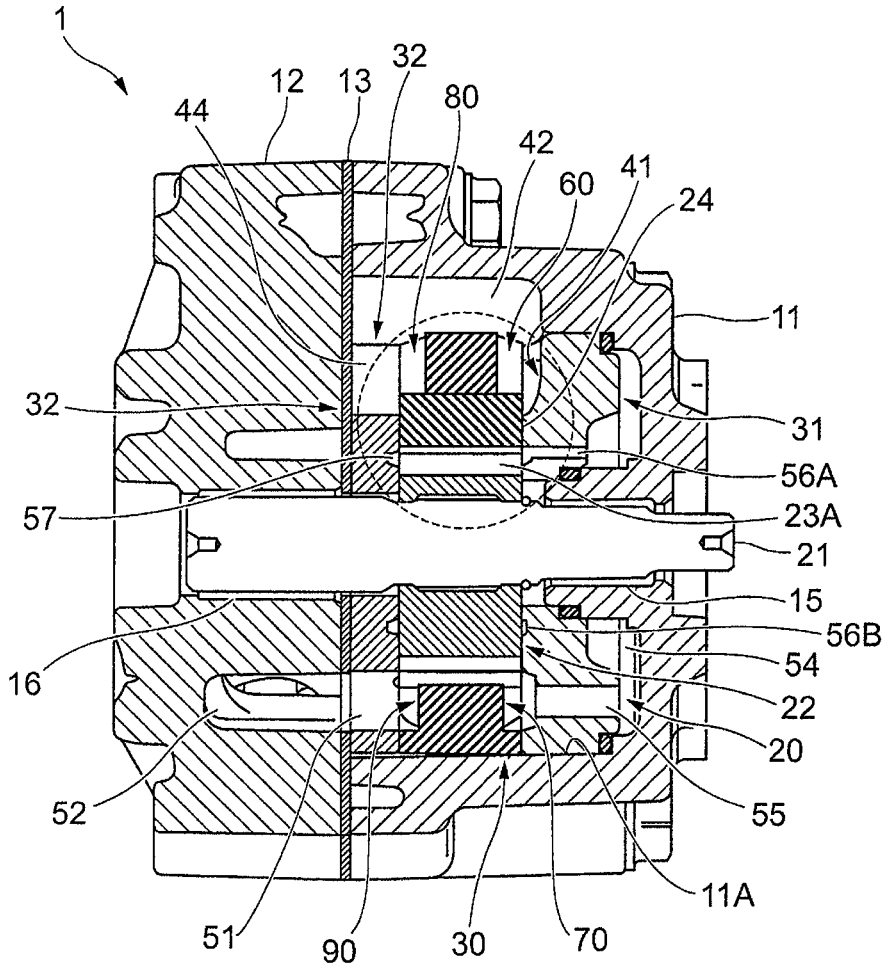
FIG. 3 is a cross-sectional view taken along line III-III of FIG. 1.
Figure 4:
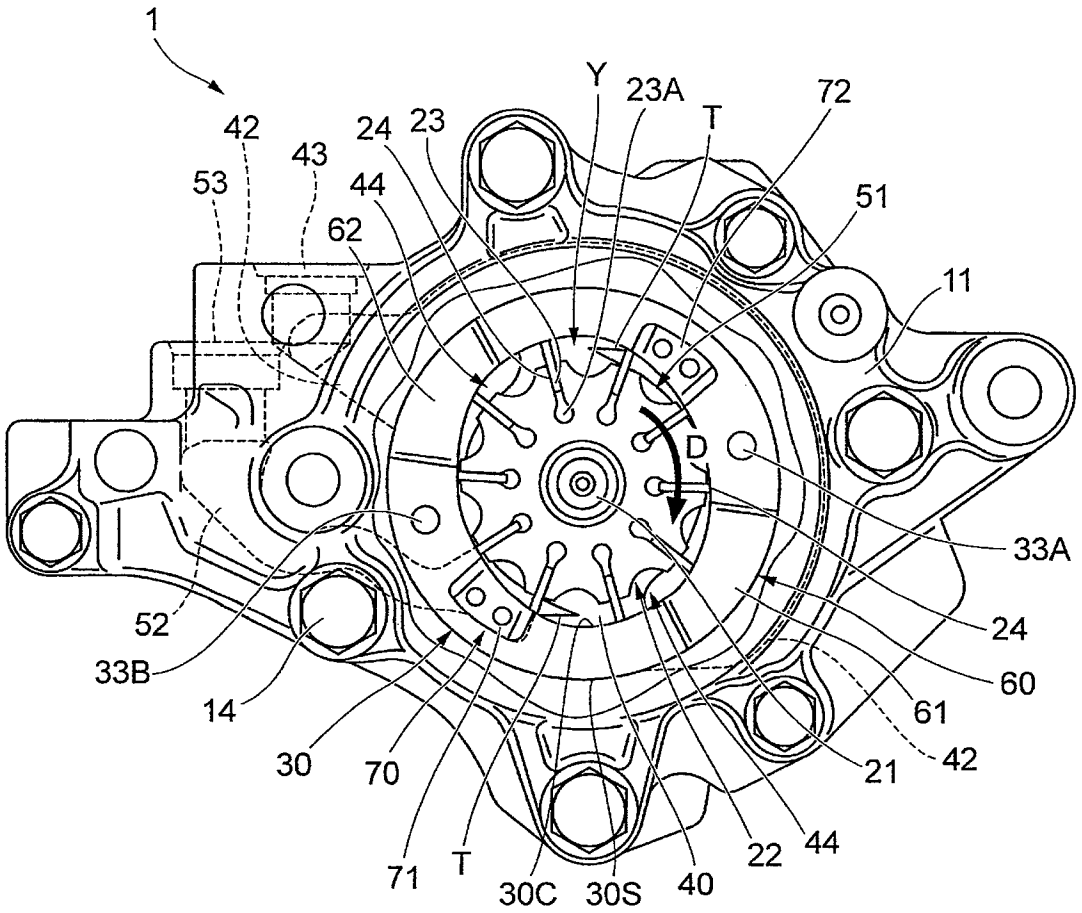
FIG. 4 is a view illustrating an inner portion of a pump unit.

FIG. 1 is an overall view of a vane pump 1 to which this configuration example is applied. FIG. 2 is a cross-sectional view taken along line II-II of FIG. 1. FIG. 3 is a cross-sectional view taken along line of FIG. 1. FIG. 4 is a view illustrating an inner portion of a pump unit 20.

Description of Configuration and Function of Vane Pump 1

The vane pump 1 is driven by, for example, power of an internal combustion engine of a vehicle, and is used as an oil pump that supplies a working oil as an example of a working fluid to fluid equipment such as a hydraulic power steering and a hydraulic continuously variable transmission.

The vane pump 1 shown in FIG. 1 is a fixed capacity type vane pump. The vane pump 1 of this configuration example includes a housing 11, a cover plate 12 that covers an opening of the housing 11, and the pump unit 20 that is accommodated inside the housing 11 and the cover plate 12.

As shown in FIG. 2, the housing 11 has an accommodation unit 11A that has a shape of a concave portion and accommodates the pump unit 20. The housing 11 has a suction inlet 43 that suctions the working oil from outside the apparatus, and a suction passage 42 that forms a passage, in the housing 11, for the working oil suctioned from the suction inlet 43. The suction passage 42 is disposed to face one end side suction port 60 and the other end side suction port 80 (described later) of a cam ring 30 (refer to FIG. 3 described later).

Further, the housing 11 forms a high-pressure chamber 54, in an innermost portion of the accommodation unit 11A of the housing 11, which is partitioned by an inner side plate 31 (described later) as shown in FIG. 3.

The cover plate 12 covers the opening of the accommodation unit 11A of the housing 11 as shown in FIG. 2. The cover plate 12 and the housing 11 are fastened by a plurality of bolts 14 and are fixed. A seal plate 13 is pinched between the cover plate 12 and the housing 11. The seal plate 13 covers and seals a plurality of passage grooves and concave portions formed in the housing 11 and the cover plate 12.

Positioning pins 33A and 33B respectively pass through the cover plate 12 and the pump unit 20 to be mounted thereon and relative positioning of each of the members is performed in a circumferential direction.

The pump unit 20 has a rotation shaft 21, a rotor 22 that is fixed to the rotation shaft 21, a plurality of vanes 24 (refer to FIGS. 3 and 4) that are slidably disposed in the rotor 22, the cam ring 30 that surrounds the rotor 22 and the vanes 24, and a pair of the inner side plate 31 and an outer side plate 32 that pinches the rotor 22, the vanes 24, and the cam ring 30 on both sides of the rotation shaft 21 in an axial direction.

The rotation shaft 21 is rotatably supported by a first bearing 15 that is disposed in the housing 11 and a second bearing 16 that is disposed in the cover plate 12. A serration (not shown) is formed in the rotation shaft 21, and the rotation shaft 21 is fixedly coupled with the rotor 22 via the serration. The rotor 22 rotates when the rotation shaft 21 receives driving from a driving source out of the vane pump 1 such as the internal combustion engine.

As shown in FIG. 4, the rotation shaft 21 (rotor 22) is configured to rotate in a D direction in FIG. 4 in this configuration example.

As shown in FIG. 4, the rotor 22 is a member that has a circular outline, and has a plurality of concavities and convexities disposed on an outer circumferential surface thereof in this configuration example. Vane grooves 23 are formed at a plurality of positions of the rotor 22 in the circumferential direction. Herein, the outer circumferential surface of the rotor 22 is shaped to protrude toward a radially outer side at parts in the circumferential direction where the vane grooves 23 are formed and to be recessed toward a radially inner side between the two vane grooves 23 adjacent to each other in the circumferential direction.

The plurality of vane grooves 23 are disposed along the circumferential direction in an outer circumferential portion of the rotor 22. Each of the vane grooves 23 is disposed along a radiation direction (radial direction). The vane grooves 23 are grooves open to the outer circumferential surface and both side surfaces of the rotor 22. The vane groove 23 accommodates each of the vanes 24 and holds the accommodated vane 24 to be slidable in the radial direction. The vane groove 23 has a bottom portion space 23A, which is wide in the circumferential direction, in a bottom portion (center side of the rotor 22).

The vanes 24 are plate-shaped members, and are mounted on the respective vane grooves 23 of the rotor 22 as described above.

Leading ends of the vanes 24 are pressed to and abut against an inner circumferential surface 30C (described later) of the cam ring 30 due to pressure of a high-pressure discharge oil that is introduced to the bottom portion spaces 23A of the vane grooves 23. A mechanism that allows the vanes 24 to abut against the inner circumferential surface 30C by using the pressure of the high-pressure discharge oil will be described in detail later.

When the rotor 22 rotates, the vanes 24 slide in the radial direction in the vane grooves 23, and is repeatedly moved to be pushed out of the vane grooves 23 or to be pushed into the vane grooves 23. In this case, during a single rotation of the rotor 22, the vanes 24 are pushed most deeply into the vane grooves 23 when the vanes 24 are at a rotation angle directed from a discharge area (described later) to a suction area (described later). When the vanes 24 are at a rotation angle directed from the suction area to the discharge area, the vanes 24 are pushed most out of the vane grooves 23.

As shown in FIG. 4, the cam ring 30 has a tubular shape, and has the inner circumferential surface 30C that forms a cam surface with a cam curve which approximates an ellipse, and a circular outer circumferential surface 30S. The cam ring 30 is disposed at a position where the outer circumferential surface 30S faces the suction passage 42 formed in the housing 11.

The cam ring 30 accommodates the rotor 22 and the vanes 24 in a tubular inner portion, that is, an area surround by the inner circumferential surface 30C. An oil chamber Y is formed between the inner circumferential surface 30C and the rotor 22. Herein, the inner circumferential surface 30C of the cam ring 30 is a surface approximating an ellipse as described above, and the rotor 22 has a circular outline. Accordingly, the oil chamber Y has an area with a wide gap in the axial direction between the inner circumferential surface 30C and the outer circumferential surface of the rotor 22 and an area with a narrow gap in the axial direction between the inner circumferential surface 30C and the outer circumferential surface of the rotor 22.

As described above, the cam ring 30, the rotor 22, and the vanes 24 are pinched by the inner side plate 31 and the outer side plate 32 on both end sides in the axial direction. Each pump chamber 40 is formed by the inner side plate 31, the outer side plate 32, the inner circumferential surface 30C of the cam ring 30, the outer circumferential surface of the rotor 22, and the two vanes 24 adjacent to each other.

A configuration and a function of the cam ring 30 will be described in detail later. With Regard to Inner Side Plate 31

Figure 5:
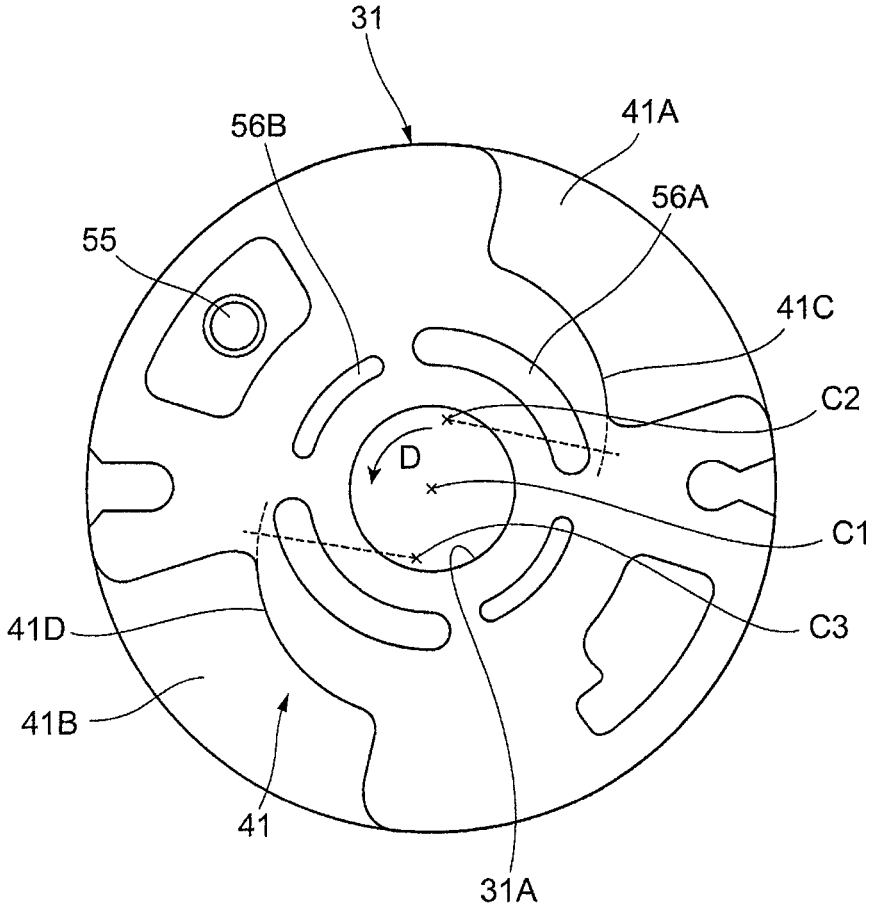
FIG. 5 is an overall view of an inner side plate of this configuration example.

FIG. 5 is an overall view of the inner side plate 31 of this configuration example. FIG. 5 shows the inner side plate 31 viewed from an arrow V shown in FIG. 2.

The inner side plate 31, which is an example of a side plate, is a member that has a disk-shaped outline as shown in FIG. 5, and has a shaft hole 31A, through which the rotation shaft 21 (refer to FIG. 4) passes, in a central portion. In addition, the inner side plate 31 has a suction port 41 and a high-pressure oil supply port 55 in an outer circumferential portion. The inner side plate 31 further has a high-pressure oil introduction port 56A and a groove 56B on a radially inner side compared to the suction port 41 and the high-pressure oil supply port 55 and in the vicinity of the shaft hole 31A.

The inner side plate 31 is disposed in the accommodation unit 11A of the housing 11 and is mounted to face one side portion of the cam ring 30 in the axial direction (refer to FIGS. 2 and 3).

The suction port 41, which is an example of a supply unit, is formed as a concave portion that is recessed in the axial direction in the outer circumferential portion of the inner side plate 31. In this configuration example, the suction port 41 is configured to have a pair of first suction port 41A and a second suction port 41B that are arranged at two positions facing each other in a diametrical direction. The suction inlet 43 (refer to FIG. 4) is allowed to communicate with the first suction port 41A and the second suction port 41B via the suction passage 42 (refer to FIG. 4) that is disposed in the housing 11. The first suction port 41A and the second suction port 41B form a path for the working oil supplied to the pump chamber 40 (refer to FIG. 4) when the rotor 22 rotates.

Herein, the first suction port 41A and the second suction port 41B can be considered as parts where the outer circumferential surface of the inner side plate 31 is recessed to the radially inner side.

An inner side end portion 41C, which is an end portion of the first suction port 41A on the radially inner side, is formed to have an arc shape. Specifically, the inner side end portion 41C is shaped to have an arc, which is smaller in radius than an outer circumferential circle of the inner side plate 31, about a center position C2, which is a position shifted to the first suction port 41A side from a center position C1 (corresponding to a rotation center of the rotor 22) of the outer circumferential circle of the inner side plate 31.

An inner side end portion 41D, which is an end portion of the second suction port 41B positioned on the radially inner side of the rotation shaft 21, is formed to have an arc shape. Specifically, the inner side end portion 41D is shaped to have an arc, which is smaller in radius than the outer circumferential circle of the inner side plate 31, about a center position C3, which is a position shifted to the second suction port 41B side from the center position C1 of the inner side plate 31.

The shapes of the inner side end portion 41C and the inner side end portion 41D can be considered as a part of an elliptical shape.

In a state where the inner side plate 31 is mounted on the cam ring 30, each of the inner side end portion 41C of the first suction port 41A and the inner side end portion 41D of the second suction port 41B, which are examples of an outer circumference of the supply unit, has a shape that has a part along the inner circumferential surface 30C of the cam ring 30. In other words, each of the inner side end portion 41C of the first suction port 41A and the inner side end portion 41D of the second suction port 41B has a shape similar to the offset of the inner circumferential surface 30C of the cam ring 30. A relationship between the inner side end portion 41C of the first suction port 41A or the inner side end portion 41D of the second suction port 41B and the inner circumferential surface 30C of the cam ring 30 will be described in detail later.

The high-pressure oil supply port 55 allows a discharge port 51 (described later) that is disposed in the outer side plate 32 to communicate with the high-pressure chamber 54. The high-pressure oil supply port 55 constitutes a passage through which the working oil, which is discharged from the discharge port 51 of the outer side plate 32 when the rotor 22 rotates, is supplied to the high-pressure chamber 54.

The high-pressure oil introduction port 56A, which is formed to pass through the inner side plate 31, is an arc-shaped groove about the center position C1. In this configuration example, the high-pressure oil introduction port 56A is disposed at two positions opposing each other around the shaft hole 31A on the same diameter of the inner side plate 31. The high-pressure oil introduction port 56A introduces the high-pressure discharge oil in the high-pressure chamber 54 to the bottom portion space 23A (refer to FIG. 4) of the vane groove 23 (refer to FIG. 4). The high-pressure oil introduction port 56A is set to communicate with the bottom portion space 23A of the vane groove 23 no matter which rotation position the rotor 22 has.

The groove 56B is an arc-shaped groove that is formed in the inner side plate 31. In this configuration example, the groove 56B is disposed at two positions pinched by the two high-pressure oil introduction ports 56A formed in the inner side plate 31. The grooves 56B communicate with the bottom portion spaces 23A (refer to FIG. 4) of some of the vane grooves 23 (refer to FIG. 4) in the circumferential direction of the rotor 22. The grooves 56B are set to communicate with the bottom portion spaces 23A of the vane grooves 23 no matter with rotation position the rotor 22 has.

With Regard to Outer Side Plate 32

Figure 6:
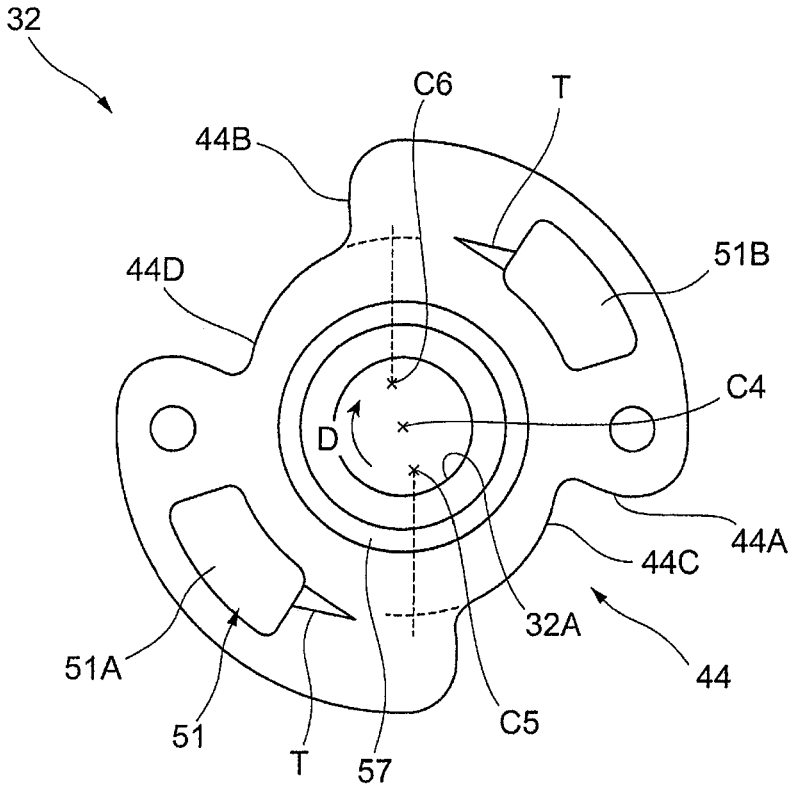
FIG. 6 is an overall view of an outer side plate of this configuration example.

FIG. 6 is an overall view of the outer side plate 32 of this configuration example. FIG. 6 shows the outer side plate 32 viewed from an arrow VI shown in FIG. 2.

The outer side plate 32, which is an example of another side plate, is a member having a disk-shaped outline as shown in FIG. 6, and has a shaft hole 32A, through which the rotation shaft 21 (refer to FIG. 4) passes, in a central portion. In addition, the outer side plate 32 has a suction port 44 and the discharge port 51 in an outer circumferential portion. In addition, the outer side plate 32 has a back pressure groove 57 in the vicinity of the shaft hole 32A. The outer side plate 32 further has groove portions T that communicate with the discharge port 51.

The outer side plate 32 is disposed in the accommodation unit 11A of the housing 11, and is mounted to face a side portion of the cam ring 30 on the side opposite to the inner side plate 31 in the axial direction (refer to FIGS. 2 and 3).

The suction port 44, which is an example of another supply unit, is formed as an opening portion that is recessed to the radially inner side in an outer circumferential portion of the outer side plate 32. In this configuration example, the suction port 44 is configured to have a pair of a first suction port 44A and a second suction port 44B that are arranged at two positions facing each other in the diametrical direction. The suction inlet 43 (refer to FIG. 4) is allowed to communicate with the first suction port 44A and the second suction port 44B via the suction passage 42 (refer to FIG. 4) that is disposed in the housing 11. The first suction port 44A and the second suction port 44B form a path for the working oil toward the pump chamber 40 (refer to FIG. 4) when the rotor 22 rotates.

An inner side end portion 44C, which is an end portion of the first suction port 44A on the radially inner side of the rotation shaft 21, is formed to have an arc shape. Specifically, the inner side end portion 44C is shaped to have an arc, which is smaller in radius than an outer circumferential circle of the outer side plate 32, about a center position C5, which is a position shifted to the first suction port 44A side from a center position C4 (corresponding to the rotation center of the rotor 22) of the outer circumferential circle of the outer side plate 32.

An inner side end portion 44D, which is an end portion of the second suction port 44B on the radially inner side of the rotation shaft 21, is formed to have an arc shape. Specifically, the inner side end portion 44D is shaped to have an arc, which is smaller in radius than the outer circumferential circle of the outer side plate 32, about a center position C6, which is a position shifted to the second suction port 44B side from the center position C4 of the outer side plate 32.

In a state where the outer side plate 32 is mounted on the cam ring 30, each of the inner side end portion 44C of the first suction port 44A and the inner side end portion 44D of the second suction port 44B, which are examples of an outer circumference of the other supply unit, has a shape that has a part along the inner circumferential surface 30C of the cam ring 30. In other words, each of the inner side end portion 44C of the first suction port 44A and the inner side end portion 44D of the second suction port 44B has a shape similar to the offset of the inner circumferential surface 30C of the cam ring 30. A relationship between the inner side end portion 44C of the first suction port 44A or the inner side end portion 44D of the second suction port 44B and the inner circumferential surface 30C of the cam ring 30 will be described in detail later.

The discharge port 51 is configured to have an opening that is formed to pass through the outer side plate 32. In this configuration example, the discharge port 51 is configured to have a first discharge port 51A and a second discharge port 51B. The first discharge port 51A and the second discharge port 51B are allowed to communicate with a discharge outlet 53 (refer to FIG. 4) of the vane pump 1 via a discharge passage 52 (refer to FIG. 4) that is disposed in the cover plate 12 such that a discharge path for the working oil from the pump chamber 40 (refer to FIG. 4) is formed when the rotor 22 rotates.

The back pressure groove 57 is a groove with an annular shape as shown in FIG. 6. The back pressure groove 57 is disposed to communicate with the bottom portion space 23A of the vane, groove 23 no matter which rotation position the rotor 22 has. The back pressure groove 57 communicates with the bottom portion spaces 23A of the entire vane grooves 23 of the rotor 22 (refer to FIG. 4). Furthermore, the back pressure groove 57 communicates also with the high-pressure chamber 54 via the high-pressure oil introduction port 56A (refer to FIG. 3) of the inner side plate 31.

As shown in FIG. 6, the groove portions T are grooves that communicate with the discharge port 51 formed in the outer side plate 32. The groove portions T are positioned on a front side (upstream side) compared to each discharge port 51 (first discharge port 51A and second discharge port 51B) in a direction of rotation of the rotor 22.

In the vane pump 1 to which this configuration example is applied, the groove portion T is disposed in the outer side plate 32, and thus the pump chamber 40 (refer to FIG. 4) reaches the groove portion T before reaching the discharge port 51 when the pump chamber 40 moves to the discharge port 51. Also, an initiation point of communication between the pump chamber 40 and the discharge port 51 is configured to be earlier than in a case where the groove portion T is not provided. As such, in the vane pump 1 of this configuration example, the length of time of the communication between the pump chamber 40 and the discharge port 51 is longer than in a configuration where the groove portion T is not provided. As a result, in the vane pump 1 of this configuration example, a surge pressure in the pump chamber 40 is alleviated and generation of an abnormal noise is reduced.

With Regard to Cam Ring 30

Figure 7C:
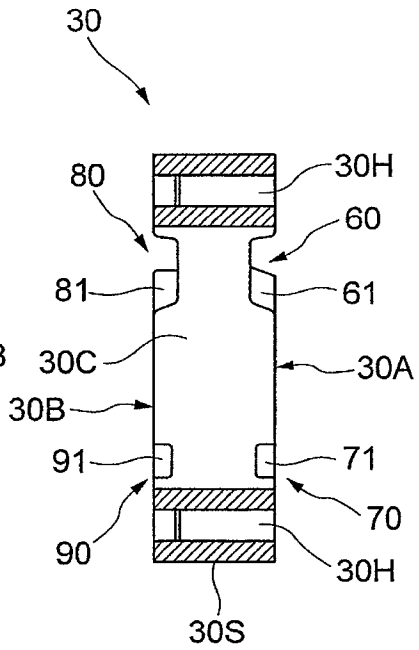
FIGS. 7A to 7C are views illustrating a cam ring of this configuration example in detail.
Figure 7B:
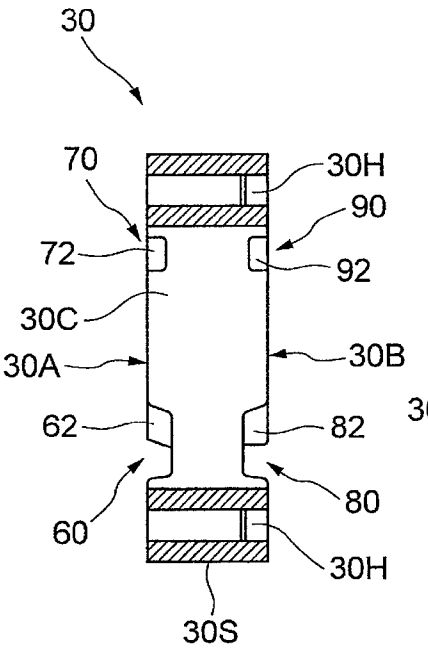
Figure 7A:
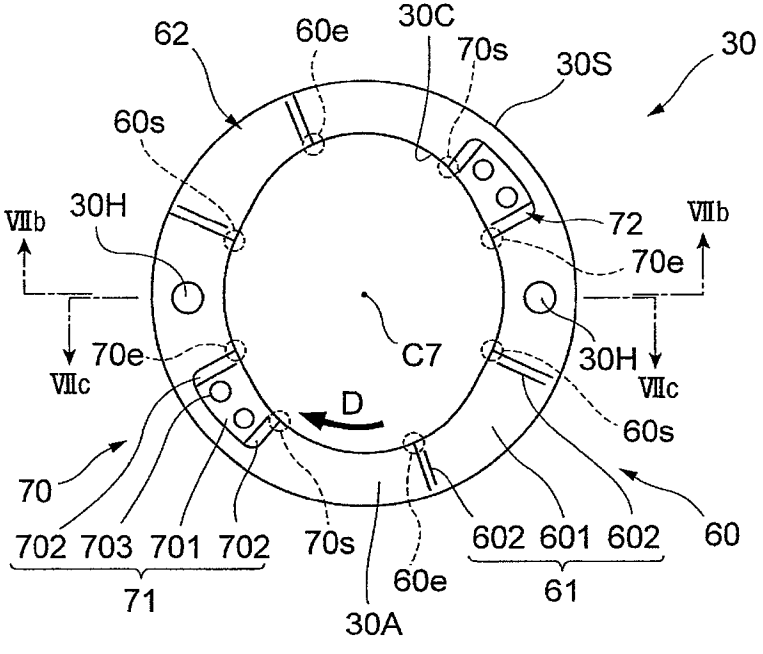

FIGS. 7A to 7C are views illustrating the cam ring 30 of this configuration example in detail.

FIG. 7A is a side view of the cam ring 30. FIG. 7B is a cross-sectional view of the cam ring 30 taken along line VIIb-VIIb of FIG. 7A, and FIG. 7C is a cross-sectional view of the cam ring 30 taken along line VIIc-VIIc of FIG. 7A.

The cam ring 30 shown in FIG. 7A, which has a tubular shape, has the inner circumferential surface 30C that forms the cam surface with the cam curve which approximate an ellipse as described above, and the circular outer circumferential surface 30S. In addition, the cam ring 30 has one end side portion 30A that has an annular shape in one side portion of the rotor 22 in the axial direction, and the other end side portion 30B (refer to FIG. 7B) that has an annular shape in the other side portion. The cam ring 30 further has pin holes 30H, through which a positioning pin 33A and a positioning pin 33B (refer to FIG. 4) pass respectively.

With Regard to One End Side Portion 30A

As shown in FIG. 7A, the one end side suction port 60 that constitutes a suction path for the working oil toward the pump chamber 40 (refer to FIG. 4) from the outer circumferential surface 30S into the inner circumferential surface 30C, and one end side discharge port 70 that constitutes the suction path for the working oil from the pump chamber 40 are formed in the one end side portion 30A.

In this configuration example, the one end side suction port 60 is configured to have a first suction port 61 and a second suction port 62. In addition, in this configuration example, the one end side discharge port 70 is configured to have a pair of a first discharge port 71 and a second discharge port 72.

The first suction port 61 and the first discharge port 71 are one set and the second suction port 62 and the second discharge port 72 are one set, respectively fulfilling a series of operations of the suction of the working oil toward the pump chamber 40 and the discharge of the working oil from the pump chamber 40.

In the following description, the first suction port 61 and the second suction port 62 are collectively referred to as the "one end side suction port 60" when not particularly distinguished, and the first discharge port 71 and the second discharge port 72 are collectively referred to as the "one end side discharge port 70" when not particularly distinguished.

With Regard to the Other End Side Portion 30B

As shown in FIGS. 7B and 7C, the other end side suction port 80 that constitutes a suction path for the working oil toward the pump chamber 40 (refer to FIG. 4), and the other end side discharge port 90 that constitutes the discharge path for the working oil from the pump chamber 40 are formed in the other end side portion 30B.

In this configuration example, the other end side suction port 80 is configured to have a first suction port 81 and a second suction port 82. In addition, in this configuration example, the other end side discharge port 90 is configured to have a pair of a first discharge port 91 and a second discharge port 92.

The first suction port 81 and the first discharge port 91 are one set and the second suction port 82 and the second discharge port 92 are one set, respectively fulfilling a series of operations of the suction of the working oil toward the pump chamber 40 and the discharge of the working oil from the pump chamber 40.

In the following description, the first suction port 81 and the second suction port 82 are collectively referred to as the "other end side suction port 80" when not particularly distinguished, and the first discharge port 91 and the second discharge port 92 are collectively referred to as "the other end side discharge port 90" when not particularly distinguished.

The other end side suction port 80 is arranged in the other end side portion 30B with the one end side suction port 60, which is formed in the one end side portion 30A, at front and back positions. Specifically, the first suction port 81 and the first suction port 61 are arranged at the front and back positions as shown in FIG. 7C. In addition, the second suction port 82 and the second suction port 62 are arranged at the front and back positions as shown in FIG. 7B.

In detail, the first suction port 81 and the first suction port 44A face each other and the first suction port 61 and the second suction port 41B face each other in a state where the cam ring 30 is pinched by the inner side plate 31 and the outer side plate 32. Accordingly, the first suction port 44A, the first suction port 81, the first suction port 61, and the second suction port 41B have an overlapping positional relationship in the circumferential direction.

Likewise, the second suction port 82 and the second suction port 44B face each other and the second suction port 62 and the first suction port 41A face each other. Accordingly, the second suction port 44B, the second suction port 82, the second suction port 62, and the first suction port 41A have an overlapping positional relationship in the circumferential direction.

The other end side discharge port 90 is arranged in the other end side portion 30B with the one end side discharge port 70, which is formed in the one end side portion 30A, at front and back positions. Specifically, the first discharge port 91 and the first discharge port 71 are arranged at the front and back positions as shown in FIG. 7C. In addition, the second discharge port 92 and the second discharge port 72 are arranged at the front and back positions as shown in FIG. 7B.

The one end side suction port 60 and the other end side suction port 80, and the one end side discharge port 70 and the other end side discharge port 90 have the same shape although respectively formed surfaces differ in the other end side portion 30B and the one end side portion 30A. Accordingly, in the following description, the one end side suction port 60 and the one end side discharge port 70 will be described as representative examples, and description of the other end side suction port 80 and the other end side discharge port 90 will be omitted.

With Regard to Configuration and Function of One End Side Suction Port 60

The one end side suction port 60 (first suction port 61 and second suction port 62) is formed as a groove that is disposed to be open in the radial direction from the inner circumferential surface 30C to the outer circumferential surface 30S. The one end side suction port 60 is configured to have a bottom surface portion 601 and an inclined portion 602.

The bottom surface portion 601 is a flat surface that is recessed in a thickness direction when compared to the other surface (hereinafter, referred to as a principal surface) of the one end side portion 30A. The bottom surface portion 601 is formed to have an increasing width in the circumferential direction from the inner circumferential surface 30C to the outer circumferential surface 30S.

The inclined portion 602 is a surface that is inclined from the principal surface of the one end side portion 30A toward the bottom surface portion 601, and is disposed to extend from the inner circumferential surface 30C toward the outer circumferential surface 30S. Two inclined portions 602 are arranged to face each other in the circumferential direction. The facing inclined portions 602 are formed to have an increasing gap from the inner circumferential surface 30C toward the outer circumferential surface 30S.

Furthermore, the first suction port 61 and the second suction port 62 are disposed at positions facing each other in the diametrical direction through a center position C7 (corresponding to the rotation center of the rotor 22) of the cam ring 30. In other words, a pair of the first suction port 61 and the second suction port 62 are arranged on a straight line through the center position C7 of the cam ring 30.

In this configuration example, the pair of the first suction port 61 and the second suction port 62 are arranged in the diametrical direction. As such, an eccentric load that is applied to, for example, the rotation shaft 21 of the rotor 22 can be reduced.

As shown in FIG. 7A, suction initiation positions 60*s* are formed in respective end portions of the first suction port 61 and the second suction port 62 on the upstream side in the direction of rotation (D direction in the drawing) of the rotor 22 (refer to FIG. 4). In addition, suction completion positions 60*e* are formed in respective end portions of the first suction port 61 and the second suction port 62 on the downstream side in the direction of rotation of the rotor 22.

The pump chambers 40 (refer to FIG. 4) that are formed by the adjacent vanes 24 (refer to FIG. 4) move in the first suction port 61 and the second suction port 62. The suction of the working oil toward the pump chamber 40 is initiated when the vanes 24 forming the pump chamber 40 reach the suction initiation position 60*s*. The suction of the working oil is completed when the pump chamber 40 passes through the suction completion position 60*e*. Configuration and Function of One End Side Discharge Port 70

As shown in FIG. 7A, the one end side discharge port 70 is formed as a groove that is disposed to be open only to the inner circumferential surface 30C side. The one end side discharge port 70 is configured to have a bottom surface portion 701, an inclined portion 702, and a through-hole 703.

The bottom surface portion 701 is a flat surface that is recessed in the thickness direction when compared to the principal surface of the one end side portion 30A.

The inclined portion 702 is a surface that is inclined from the principal surface of the one end side portion 30A toward the bottom surface portion 701, and is disposed to extend from the inner circumferential surface 30C toward the outer circumferential surface 30S. Two inclined portions 702 are arranged to face each other in the circumferential direction.

The through-hole 703 is formed in the bottom surface portion 701 and passes through to the other end side discharge port 90. As such, the discharge oil is allowed to communicate with the one end side portion 30A and the other end side portion 30B of the cam ring 30 therebetween.

As shown in FIG. 7A, in the first discharge port 71 and the second discharge port 72, discharge initiation positions 70*s* are formed in respective end portions of the first discharge port 71 and the second discharge port 72 on the upstream side in the direction of rotation (D direction in the drawing) of the rotor 22 (refer to FIG. 4). In addition, discharge completion positions 70*e* are formed in respective end portions of the first discharge port 71 and the second discharge port 72 on the downstream side in the direction of rotation of the rotor 22.

The pump chambers 40 (refer to FIG. 4) that are formed by the adjacent vanes 24 (refer to FIG. 4) move in the first discharge port 71 and the second discharge port 72. The discharge of the working oil from the pump chamber 40 is initiated when the vanes 24 forming the pump chamber 40 reach the discharge initiation positions 70*s*. The discharge of the working oil is completed when the pump chamber 40 passes through the discharge completion positions 70*e*.

The second suction port 62 of the one end side suction port 60 that has the above-described configuration is disposed along a flow path part of the suction passage 42 that extends toward the second suction port 62. In other words, in this configuration example, the flow path part that extends from the suction passage 42 toward the second suction port 62 and the second suction port 62 are arranged to have a consistent main flow direction of the working oil and are arranged to have angles matching with each other. In this manner, in this configuration example, the working oil that flows through the suction passage 42 flows straightforwardly into the second suction port 62. As such, in this configuration example, the working oil flows to the second suction port 62 efficiently.

Operation of Vane Pump 1

In the vane pump 1 that has the above-described configuration, the rotor 22 rotates when the rotation shaft 21 rotates by receiving the driving from, for example, the internal combustion engine (not shown) as shown in FIG. 4. When the rotor 22 rotates, the leading ends of the plurality of vanes 24 are in a rotating state while being pressed to the inner circumferential surface 30C on an inner circumference of the cam ring 30.

Herein, in the vane pump 1, the working oil that is supplied from the suction inlet 43 is in a state of flowing into the one end side suction port 60 and the other end side suction port 80 of the cam ring 30 via the suction passage 42. Then, in the suction area on the upstream side in the direction of rotation of the rotor 22, the working oil from the suction port 41 of the inner side plate 31 and the suction port 44 of the outer side plate 32 is suctioned to the pump chamber 40 that expands when the rotor 22 rotates. The suction area refers to an area where the suction port 41 of the inner side plate 31 and the suction port 44 of the outer side plate 32 are disposed in the circumferential direction.

In the discharge area on the downstream side in the direction of rotation of the rotor 22, the working oil from the pump chamber 40 that is compressed when the rotor 22 rotates is discharged to the discharge port 51. The high-pressure discharge oil that is discharged to the discharge port 51 is discharged from the discharge outlet 53 through the discharge passage 52. The discharge area refers to an area where the discharge port 51 of the outer side plate 32 is disposed in the circumferential direction.

The vane pump 1 to which this configuration example is applied fulfills a pump operation in the above-described manner such that the working oil suctioned by the suction inlet 43 is discharged from the discharge outlet 53.

Next, an abutting operation of the inner circumferential surface 30C of the vane 24 of the vane pump 1 according to this configuration example will be descried.

As shown in FIG. 3, the high-pressure discharge oil that is discharged from the discharge port 51 due to the rotation of the rotor 22 is supplied to the high-pressure chamber 54 through the bottom portion spaces 23A of some of the vane grooves 23 of the rotor 22 and the high-pressure oil supply port 55. Furthermore, the high-pressure discharge oil with which the high-pressure chamber 54 is filled is supplied to the annular back pressure groove 57 of the outer side plate 32 via the high-pressure oil introduction port 56A of the inner side plate 31 and the bottom portion spaces 23A of some of the vane grooves 23 of the rotor 22.

The high-pressure discharge oil that is introduced to the bottom portion spaces 23A of the vane grooves 23 which do not communicate with the high-pressure oil introduction port 56A of the inner side plate 31 is pushed to fill the groove 56B of the inner side plate 31.

The high-pressure discharge oil that is supplied to the annular back pressure groove 57 is in a state of being introduced at the same time to the bottom portion spaces 23A of the entire vane grooves 23 of the rotor 22 with which the back pressure groove 57 communicates. The leading ends of the vanes 24 are pressed to the inner circumferential surface 30C of the cam ring 30 due to the pressure of the high-pressure discharge oil which is introduced to the bottom portion spaces 23A of the vane grooves 23.

Operation of Vane 24 in Vicinity of Suction Port 41

Figure 8:
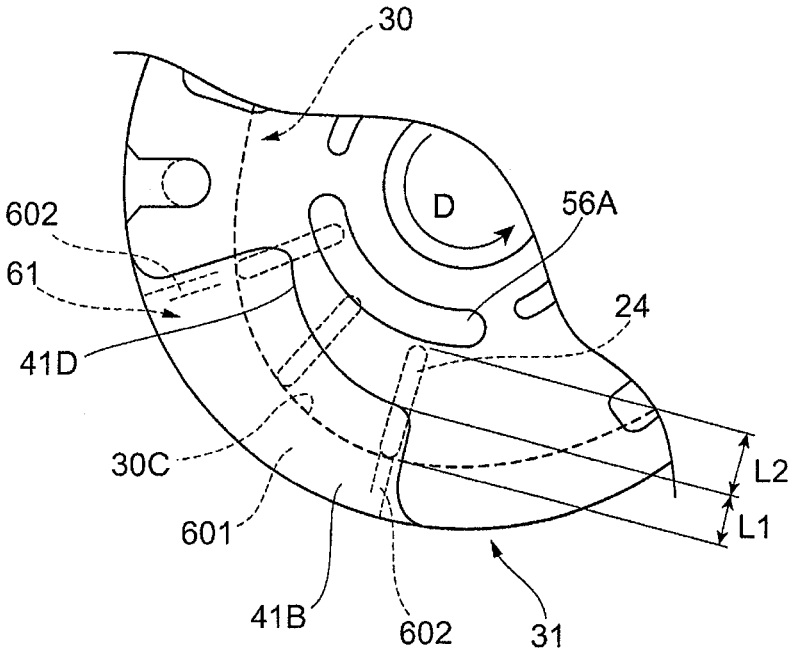
FIG. 8 is a view illustrating an operation of a vane in the vicinity of a suction port of this configuration example.

FIG. 8 is a view illustrating an operation of the vane 24 in the vicinity of the suction port 41 of this configuration example.

As described above, the first suction port 41A and the second suction port 41B of the suction port 41 of the inner side plate 31 have the same shape. In the following description, the operation of the vane 24 in the vicinity of the second suction port 41B will be described as a representative example, and description of the operation of the vane 24 in the vicinity of the first suction port 41A will be omitted.

As shown in FIG. 8, the inner side end portion 41D of the second suction port 41B is shaped along the inner circumferential surface 30C of the cam ring 30. Accordingly, the distance (length in the radial direction) between the inner side end portion 41D of the second suction port 41B and the inner circumferential surface 30C of the cam ring 30 is constant in the suction area. In other words, an opening with a constant width in the radial direction is formed between the inner side end portion 41D and the inner circumferential surface 30C of the cam ring 30. As such, a period when the length (refer to a length L1) of a part where the vane 24 protrudes from the inner side plate 31 (inner side end portion 41D) to the radially outer side is constant is present when the vane 24 that rotates when the rotor 22 rotates passes through the suction area. Accordingly, inclination of the vane 24 with respect to the rotation shaft 21 of the rotor 22 is suppressed (described in detail later).

Herein, the second suction port 41B of the example that is shown can be considered to have a shape in which the area where the length of the part where the vane 24 protrudes from the inner side plate 31 to the radially inner side is constant is formed.

In addition, the second suction port 41B of the example that is shown can be considered that the upstream side part of the inner side end portion 41D in the direction of the rotation (D direction in the drawing) of the rotor 22 (refer to FIG. 4) is shaped along the inner circumferential surface 30C of the cam ring 30.

Furthermore, the second suction port 41B of the example that is shown can be considered that the part of the inner side end portion 41D that faces the first suction port 61 of the cam ring 30 is shaped along the inner circumferential surface 30C of the cam ring 30. In further detail, a part of the inner side end portion 41D of the second suction port 41B overlapping with the area where the bottom surface portion 601 of the first suction port 61 is formed in the circumferential direction can be considered to be shaped along the inner circumferential surface 30C of the cam ring 30.

Operation of Vane 24 in Vicinity of Suction Port 44

Figure 9:
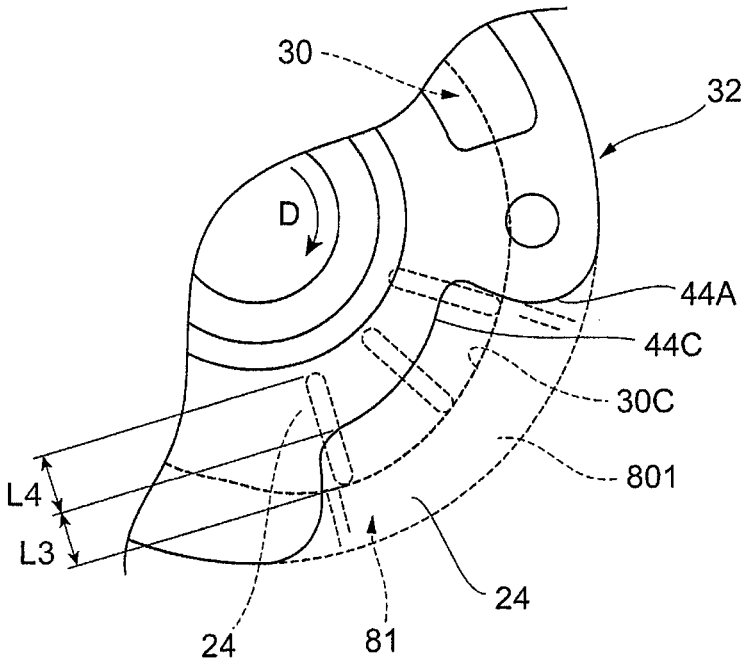
FIG. 9 is a view illustrating the operation of the vane in the vicinity of the suction port of this configuration example.

FIG. 9 is a view illustrating the operation of the vane 24 in the vicinity of the suction port 44 of this configuration example.

As described above, the first suction port 44A and the second suction port 44B of the suction port 44 of the outer side plate 32 have the same shape. In the following description, the operation of the vane 24 in the vicinity of the first suction port 44A will be described as a representative example, and description of the operation of the vane 24 in the vicinity of the second suction port 44B will be omitted.

As shown in FIG. 9, the inner side end portion 44C of the first suction port 44A is shaped along the inner circumferential surface 30C of the cam ring 30. Accordingly, the distance (length in the radial direction) between the inner side end portion 44C of the first suction port 44A and the inner circumferential surface 30C of the cam ring 30 is constant in the suction area. In other words, an opening with a constant width in the radial direction is formed between the inner side end portion 44C and the inner circumferential surface 30C of the cam ring 30. As such a period when the length (refer to a length L3) of a part where the vane 24 protrudes from the outer side plate 32 (inner side end portion 44C) to the radially outer side is constant is present when the vane 24 that rotates when the rotor 22 rotates passes through the suction area. Accordingly, inclination of the vane 24 with respect to the rotation shaft 21 of the rotor 22 is suppressed (described in detail later).

Herein, the first suction port 44A of the example that is shown can be considered to have a shape in which the area where the length of the part where the vane 24 protrudes from the outer side plate 32 to the radially outer side is constant is formed.

In addition, the first suction port 44A of the example that is shown can be considered that the upstream side part of the inner side end portion 44C in the direction of the rotation (D direction in the drawing) of the rotor 22 (refer to FIG. 4) is shaped along the inner circumferential surface 30C of the cam ring 30.

Furthermore, the first suction port 44A of the example that is shown can be considered that the part of the inner side end portion 44C that faces the first suction port 81 of the cam ring 30 is shaped along the inner circumferential surface 30C of the cam ring 30. In further detail, a part of the inner side end portion 44C of the first suction port 44A overlapping with the area where a bottom surface portion 801 of the first suction port 81 is formed in the circumferential direction can be considered to be shaped along the inner circumferential surface 30C of the cam ring 30.

Inclination of Vane 24

Figure 10:
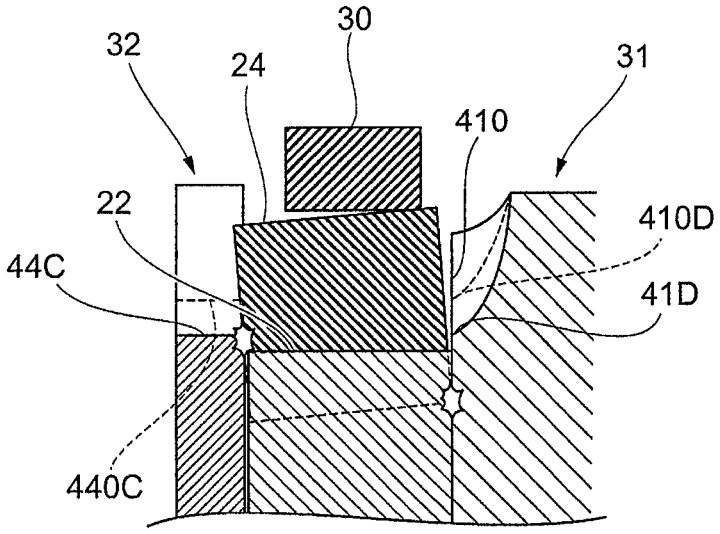
FIG. 10 is a view illustrating an inclination of the vane of this configuration example.

FIG. 10 is a view illustrating the inclination of the vane 24 of this configuration example. In further detail, FIG. 10 shows an area in the circle shown in FIG. 3.

A configuration in which the inner side end portion 41D of the second suction port 41B or the inner side end portion 44C of the first suction port 44A is placed closer to the rotation shaft 21 side of the rotor 22 to increase a suction area where the working oil is suctioned can be considered in a case where the efficiency of the suction of the working oil is to be increased in the vane pump 1. However, when the inner side end portion 41D of the second suction port 41B or the inner side end portion 44C of the first suction port 44A is simply placed closer to the rotation shaft 21 side of the rotor 22, the durability of the vane pump 1 may be deteriorated. Herein, the efficiency of the suction simply refers to the amount (volume) of the working oil that passes through the suction port 41 per hour.

Describing specifically with reference to FIG. 10, the suction area where the working oil is suctioned increases and the efficiency of the suction increases as the inner side end portion 41D and the inner side end portion 44C are moved to the rotation shaft 21 (refer to FIG. 4) of the rotor 22, that is, the lower side in FIG. 10. However, when the inner side end portion 41D and the inner side end portion 44C are moved to the lower side in the drawing, the length (refer to the length L1 in FIG. 8 and the length L3 in FIG. 9) of the part where the vane 24 protrudes from the inner side plate 31 or the outer side plate 32 to the radially outer side (upper side in the drawing) increases. As the length of the protruding part increases, the length (refer to a length L2 in FIG. 8 and a length L4 in FIG. 9) of the area where the vane 24 is supported by the inner side plate 31 or the outer side plate 32 decreases. As a result, the vane 24 is likely to be inclined with respect to the rotation shaft 21 of the rotor 22.

Accordingly, a corner of the vane 24, which is a plate-shaped member, is more likely to abut against the inner side plate 31 or the outer side plate 32 than in a case where, for example, radial positions of the inner side end portion 41D and the inner side end portion 44C are positioned outside (refer to an inner side end portion 410D and an inner side end portion 440C shown by the dashed lines in the drawing). This, for example, may result in damage (burning) to the inner side plate 31 or the outer side plate 32 and the generation of the abnormal noise. Alternatively, the inner side plate 31 or the outer side plate 32 is likely to be worn, and the durability of the vane pump 1 may be deteriorated.

In this configuration example, the positions of the inner side end portion 41D and the inner side end portion 44C are determined such that the vane 24 protrudes from the inner side plate 31 or the outer side plate 32 by less than half of the length in the radial direction. In detail, the length L1 in FIG. 8 is smaller than the length L2, or the length L3 in FIG. 9 is smaller than the length L4. More preferably, the positions of the inner side end portion 41D and the inner side end portion 44C are determined such that the vane 24 protrudes from the inner side plate 31 or the outer side plate 32 by less than four-tenths of the length in the radial direction.

In this configuration example described above, the length at which the vane 24 protrudes from the inner side plate 31 or the outer side plate 32 to the radially outer side is constant when the rotor 22 rotates to cause the vane 24 to pass through the suction area. In other words, the vane 24 and the inner side plate 31 or the outer side plate 32 have constant relative positions. As such, the position of the vane 24, which is likely to have an unstable posture when passing through the suction area to suction the working oil, is not shifted with respect to the positions of the inner side plate 31 or the outer side plate 32, and the inclination of the vane 24 in response to an external force from the inner side plate 31 or the outer side plate 32 is suppressed.

Another Configuration Example

Figure 11:
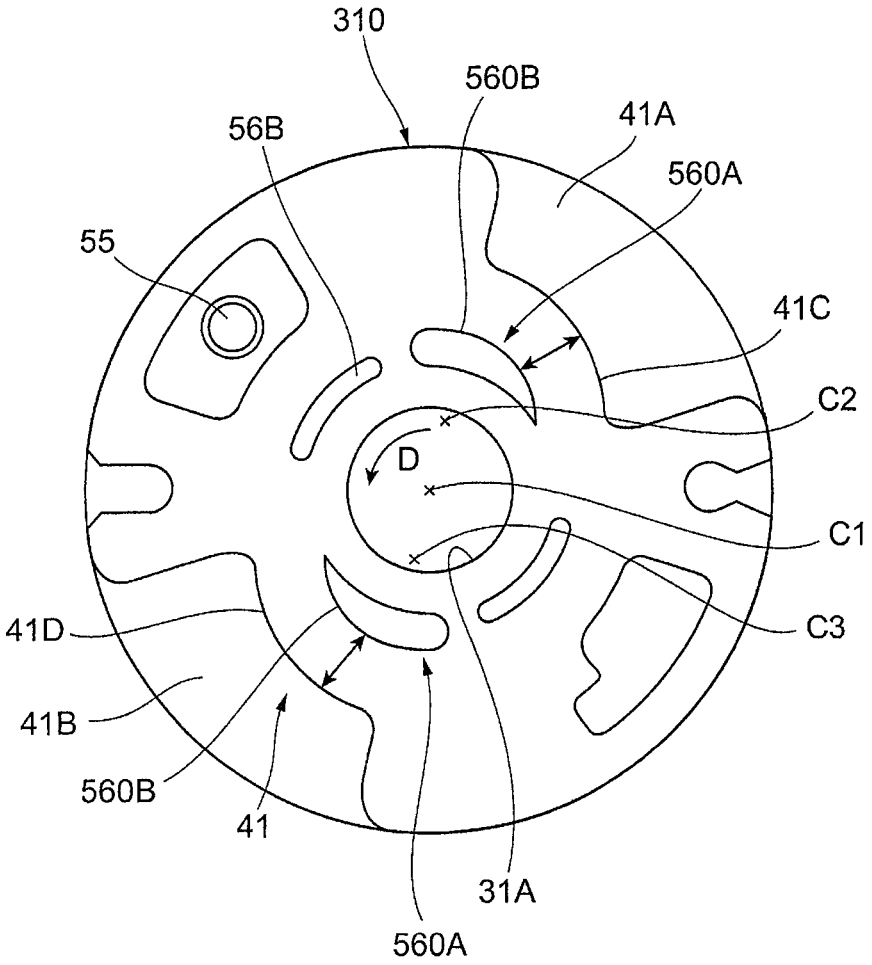
FIG. 11 is an overall view of an inner side plate of another configuration example.

FIG. 11 is an overall view of an inner side plate 310 of another configuration example.

In the following description, the same reference numerals are used in the parts that are identical to those of the inner side plate 31 shown in FIG. 5, and detailed description thereof will be omitted.

In the above description, the high-pressure oil introduction port 56A is an arc-shaped groove about the center position C1 which is formed through the inner side plate 31.

In contrast, according to a high-pressure oil introduction port (through-hole) 560A shown in FIG. 11, a radially outer side end portion 560B, which is an end portion of the rotation shaft 21 positioned on the radially outer side, is shaped along the inner side end portion 41C of the first suction port 41A (inner side end portion 41D of the second suction port 41B). In detail, the radially outer side end portion 560B of the high-pressure oil introduction port 560A is shaped along the inner circumferential surface 30C of the cam ring 30. In this manner, the distance (length in the radial direction, refer to the arrow in the drawing) between the radially outer side end portion 560B and the inner side end portion 41C of the first suction port 41A (inner side end portion 41D of the second suction port 41B) is constant.

Herein, the pressure of the working oil in the high-pressure oil introduction port 560A where the high-pressure discharge oil introduced is higher than the pressure of the working oil in the first suction port 41A. Accordingly, when the distance between the radially outer side end portion 560B and the inner side end portion 41C of the first suction port 41A (inner side end portion 41D of the second suction port 41B) decreases, the working oil may flow (leak) from the high-pressure oil introduction port 560A toward the first suction port 41A.

In this configuration example, the radially outer side end portion 560B of the high-pressure oil introduction port 560A is shaped along the inner side end portion 41C of the first suction port 41A (inner side end portion 41D of the second suction port 41B). Accordingly, when compared to a case in which this configuration is not adopted, the leak of the working oil from the high-pressure oil introduction port 560A into the first suction port 41A is suppressed.

In detail, in this configuration example, an area between the high-pressure oil introduction port 560A and the inner side end portion 41C of the first suction port 41A (inner side end portion 41D of the second suction port 41B), that is, an area where the working oil is sealed between the high-pressure oil introduction port 560A and the first suction port 41A has a constant width. The amount of leak of the working oil can be adjusted by determining the width of the area, and the design of the inner side plate 310 is facilitated with the configuration of this configuration example.

Modification Example

In the above description, each of the inner side end portion 41C and the inner side end portion 41D of the inner side plate 31 and the inner side end portion 44C and the inner side end portion 44D of the outer side plate 32 are shaped along the inner circumferential surface 30C of the cam ring 30. However, any one of the inner side end portion 41C, the inner side end portion 41D, the inner side end portion 44C, and the inner side end portion 44D may be shaped along the inner circumferential surface 30C of the cam ring 30.

For example, the inner side end portion 41C and the inner side end portion 41D of the inner side plate 31 may be shaped along the inner circumferential surface 30C of the cam ring 30 and the inner side end portion 44C and the inner side end portion 44D of the outer side plate 32 may be shaped along the arc about the center position C4 of the outer side plate 32.

In addition, the inner side end portion 44C and the inner side end portion 44D of the outer side plate 32 may be shaped along the inner circumferential surface 30C of the cam ring 30 and the inner side end portion 41C and the inner side end portion 41D of the inner side plate 31 may be shaped along the arc about the center position C1 of the inner side plate 31.

In the above description, the groove portion T is disposed in the outer side plate 32. However, the groove portion T may be disposed in the inner side plate 31, and the groove portion T may be disposed in each of the inner side plate 31 and the outer side plate 32.

What is claimed is:

1. A vane pump comprising:

a rotor that is coupled with a rotation shaft to rotate;

a plurality of vanes that are slidably held by a plurality of vane grooves which are disposed in a radiation direction in an outer circumferential portion of the rotor;

a cam ring that is arranged to surround the rotor and the plurality of vanes;

a side plate that covers the cam ring and includes a suction port which is configured to supply a working fluid to the cam ring and is formed on an outer circumference of the side plate as a portion being recessed to a radially inner side of the rotation shaft to form the supply unit; and wherein the suction port has an inner end portion, which extends along and is spaced from an inner circumference of the cam ring by a constant distance in a radial direction of the rotation shaft.

2. The vane pump according to claim 1, further comprising:

another side plate that is arranged on a side opposite to the side plate across the cam ring to cover the cam ring and includes another suction port which is configured to supply the working fluid to the cam ring and is formed on an outer circumference of the other side plate as a portion being recessed to the radially inner side of the rotation shaft, and wherein the other suction port has another inner end portion, which extends along and is spaced from the inner circumference of the cam ring by another constant distance in a radial direction of the rotation shaft.

3. The vane pump according to claim 2, wherein the side plate includes a through-hole, on the radially inner side of the rotation shaft compared to the other suction portion, which supplies the working fluid pressing the plurality of vanes to allow the plurality of vanes to protrude from the rotor into the cam ring, and the through-hole is formed in such a manner that an outer end portion thereof extends and is spaced from the inner circumference of the cam ring by another constant distance in the radial direction.

4. The vane pump according to claim 1, wherein the side plate includes a through-hole, on the radially inner side of the rotation shaft compared to the suction portion, which supplies the working fluid pressing the plurality of vanes to allow the plurality of vanes to protrude from the rotor into the cam ring, and the through-hole is formed in such a manner that an outer end portion thereof extends and is spaced from the inner circumference of the cam ring by a constant distance in the radial direction.

5. The vane pump according to claim 1, wherein the inner end portion of the suction portion has an arc shape, which is smaller in radius than an outer circumferential circle of the side plate.

6. The vane pump according to claim 5, wherein the arc shape of the inner end portion is a part of an elliptical shape.

7. The vane pump according to claim 1, wherein an opening with the constant distance in the radial direction is formed between the inner end portion and the inner circumference of the cam ring.

8. The vane pump according to claim 7, wherein in the opening, the vane is configured to protrude by the constant distance to a radially outer side of the rotation shaft when the vane is in operation.

9. The vane pump according to claim 1, wherein a position of the inner end portion is determined such that the vane protrudes from the inner side plate by less than half of the length thereof in the radial direction.

* * * * *